United States Patent [19]

Zimmermann

[11] 4,088,144

[45] May 9, 1978

[54] ARRANGEMENT FOR COUNTING DIFFERENT-DENOMINATION COINS AND SIMILAR DISK-SHAPED OBJECTS

[75] Inventor: Gert Zimmermann, Berlin, Germany

[73] Assignee: F. Zimmermann & Co., Berlin, Germany

[21] Appl. No.: 727,871

[22] Filed: Sep. 29, 1976

[30] Foreign Application Priority Data

Oct. 22, 1975 Germany ..... 2547685

[51] Int. Cl.[2] ..... G07D 3/00

[52] U.S. Cl. ..... 133/3 F; 133/8 E

[58] Field of Search ..... 133/3 R, 3 A, 3 D, 3 F, 133/3 H, 8 R, 8 E; 194/99, 102, 1 K, 1 E, DIG. 15; 250/227, 560, 561; 192/84 P; 198/370, 530; 193/15, 16, DIG. 1

[56] References Cited

U.S. PATENT DOCUMENTS

| | | | |
|---|---|---|---|
| 2,487,693 | 11/1949 | Canon | 198/530 |
| 3,086,536 | 4/1963 | Klop | 133/3 R X |
| 3,351,180 | 11/1967 | Herzog et al. | 198/370 |
| 3,726,290 | 4/1973 | Zimmermann | 133/39 |
| 3,939,954 | 2/1976 | Collins | 133/8 R X |
| 3,959,729 | 5/1976 | Marchetti | 250/227 |
| 4,015,122 | 3/1977 | Rubinstein | 250/227 X |

*Primary Examiner*—Allen N. Knowles
*Assistant Examiner*—Fred A. Silverberg
*Attorney, Agent, or Firm*—Max Fogiel

[57] ABSTRACT

An arrangement for counting the values of different-denomination coins and other disk-shaped objects in which the coins are transported in an irregular sequence with their rims along a rectilinear guiding edge on a guide track. A scanning head identifies the coin, and is located at the start of the rectilinear guiding edge. The scanning head has several photoconductor strands having free ends located at varying distances from the guiding edge. Photocells are connected to the other ends of the strands, and a light-beam element illuminates the free ends of the photoconductor strands. The photoconductor strands and the light-beam element are separated by a scanning gap for passage of the coins. The photoconductor strands are located along a line perpendicular to the guiding edge inside as holder which is inserted in the guide track. The free ends of the photoconductor strands are flush with the surface of the guide track. One photoconductor strand is associated with each of the coins of varying diameter.

15 Claims, 3 Drawing Figures

ARRANGEMENT FOR COUNTING DIFFERENT-DENOMINATION COINS AND SIMILAR DISK-SHAPED OBJECTS

BACKGROUND OF THE INVENTION

The present invention relates to an arrangement for the value-wise counting of different-denomination coins and other disk-shaped objects which are transported in an irregular sequence with their rim along a rectilinear guiding edge on a guide track, with a scanning head identifying the coin.

It is already known in the art how to sort coins and similar objects by their diameter and to guide them for this purpose along a sorting section with size-wise staggered dropout openings and to count the coins sorted by size. There are also known counting devices provided with search coils which are located as scanning heads at the drop-out points for the coins and deliver a count pulse. The number of scanning heads depends on the number of coin types that have to be counted.

The value-wise counting process for all coins of various denominations is done by adding the counted coins of all denominations. The counting out of the coins by value proceeds relatively slowly and the more counting locations there are, the greater is the danger of errors. In addition, the known devices require extensive and expensive construction efforts.

It is, therefore, an object of the present invention to provide an arrangement of the type described initially where the coins have to pass only one scanning head, making precise contact with the guiding edge, so that the counting can proceed quickly and without error, and where the single scanning head can identify the coins arriving in irregular sequence with different diameters according to their value. The scanning head is made simple and provides operational safety for the scanning head.

Another object of the present invention is to provide an arrangement of the foregoing character which may be economically fabricated and maintained in service.

A further object of the present invention is to provide an arrangement, as described, which has a substantially long operating life.

SUMMARY OF THE INVENTION

The objects of the present invention are achieved by providing that the scanning head, located at the start of the rectilinear guiding edge, comprises several photoconductor strands whose free ends are located at varying distances from the guiding edge and whose other ends are each connected to a photocell. The head further comprises a light-beam element illuminating the free ends of the photoconductor strands. The photoconductor strands and light-beam elements are separated by a scanning gap for passage of the coins. When using the arrangement in accordance with the present invention, the sorting of coins by diameter is eliminated and the entire value-wise counting of all the different coins proceeds much faster than at present with the electronic counter attached to the photocells.

The result of the value-wise counting of all coins is maintained with the passage of the coins past the scanning head. It is immaterial in what sequence different coins pass the scanning head. The total value can always be read on the electronic counter, where it is immediately indicated without error. A single scanning head is necessary for identifying the value of all coins.

According to the present invention, it consists of a bundle of photoconductor strands whose free ends are illuminated by light-beam elements and whose other ends are connected to photocells which also are connected to the electronic counter. As soon as a coin passes the scanning gap between the free ends of the photoconductor strands and the light-beam elements, a certain number of photoconductor strands is darkened, which is registered by the electronic counter and as a result of which the electronic counter can identify a certain coin whose value is counted. However, it is counted only after the coin has again cleared a photoconductor strand. Since, due to the varying diameters of the coins of a series of coins, each coin passing the guiding edge covers a certain number of photoconductor strands in a certain sequence, any coin of a series can be identified value-wise and counted. The scanning head operates without error, it does not depend on the material composition of the coins so that even coins or disk-like objects made of plastic can be counted.

In a preferred embodiment, the photoconductor strands are arranged with their free ends along a line perpendicular to the guiding edge within a photoconductor holder inserted in the guide track. The free ends of the photoconductor strands are flush with the surface of the guide track. In this embodiment, the light-beam elements are located above the guide track at the distance of the scanning gap. Each of the varying diameters of a coin series may be assigned to a photoconductor strand. Since different coin series have differently graduated coin diameters, in another embodiment of the present invention, the photoconductor strands may be located at close regular intervals along a rectilinear line in the photoconductor holder, with each photoconductor assigned to a coin of the varying diameter coin series connected to a photocell. With this embodiment, the photoconductor holders may be produced uniformly in large quantities. The only requirement is that by suitably connecting the associate photoconductor strands to their photocells, they are adjusted to the graduations in coin diameter.

In another advantageous embodiment of the present invention, the arrangement of the above type with a centrifugal plate provides that the guiding edge at some distance ahead of the scanning head turns into an oblique guiding edge which is tangential to the centrifugal plate and to which the coins are delivered tangentially in the direction of rotation of the centrifugal plate. For transporting the coins along the start-up edge and the guiding edge, there is a pair of endless belts with one endless belt running into the start-up edge behind the centrifugal plate and with a second endless belt passing between the guiding edge and the scanning head and running faster than the first endless belt. This construction ensures that the coins to be identified by the scanning head make clean (good) contact with the guiding edge. Due to this construction, the coins are pressed by the first endless belt against the start-up edge, are then passed on to the second endless belt, are separated by its greater speed and moved past the scanning head with force-linked contact with the guiding edge. In another preferred embodiment, the guiding edge and the second endless belt make an angle of 0.5° with each other, so that the coin, even when transported along the rectilinear guiding edge, is continuously pressed against the guiding edge.

In order to make the contact with the start-up and guiding edge even more certain, another improvement provides that opposite the start-up edge a spring-loaded rocking lever is pivotably mounted in a quarter-circle-shaped groove of the guide track, and that the rocking lever provides passage to the coins approaching the start-up edge separately for further transport by the second endless belt. The spring-loaded rocking lever prevents a coin from being delivered from the centrifugal plate to the guide track, without the coin being transported by the first endless belt along (or toward) the oblique start-up edge. The spring-load on the rocking-lever can be chosen so that only the moving force of the two endless belts can move the rocking lever to provide passage for the coin. To separate the coins leaving the centrifugal plate, spring elements may be directed toward the guide track in the area of the oblique start-up edge and at varying intervals from it. These spring elements exert a similar effect on the coins as the spring-loaded rocking lever. Also, rocking lever and spring elements may be provided jointly.

If the arrangement is to stop upon reaching a certain number of a certain type of coin, for example, after 100 5.- DM coins, in accordance with another improvement of the present invention, a stopping mechanism comprising a pivotably mounted leaf spring, controlled by an electromagnet, may be provided ahead of the scanning head; the free end of this leaf spring is provided with a coating for holding the coin to the guide track. As soon as the scanning head had identified the desired quantity of coins of one type, e.g., 100 5 DM pieces, a signal is applied to the stopping mechanism; the leaf spring is pivoted via the electromagnet, so that the coin following the 100th 5 DM coin is reliably held on the guide track. Of course, several leaf springs can be located next to each other. The leaf spring adjacent to the scanning head can be provided with an end stop which directly presses against the surface of the guide track.

The arrangement can be used both for counting and subsequent sorting of coins along a sorting section and also for the pure counting of the coins arriving in irregular sequence. In this case, a drop-out opening, which can be shut with a slide, is located in the guide track in the transport direction of the coins, behind the scanning head.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
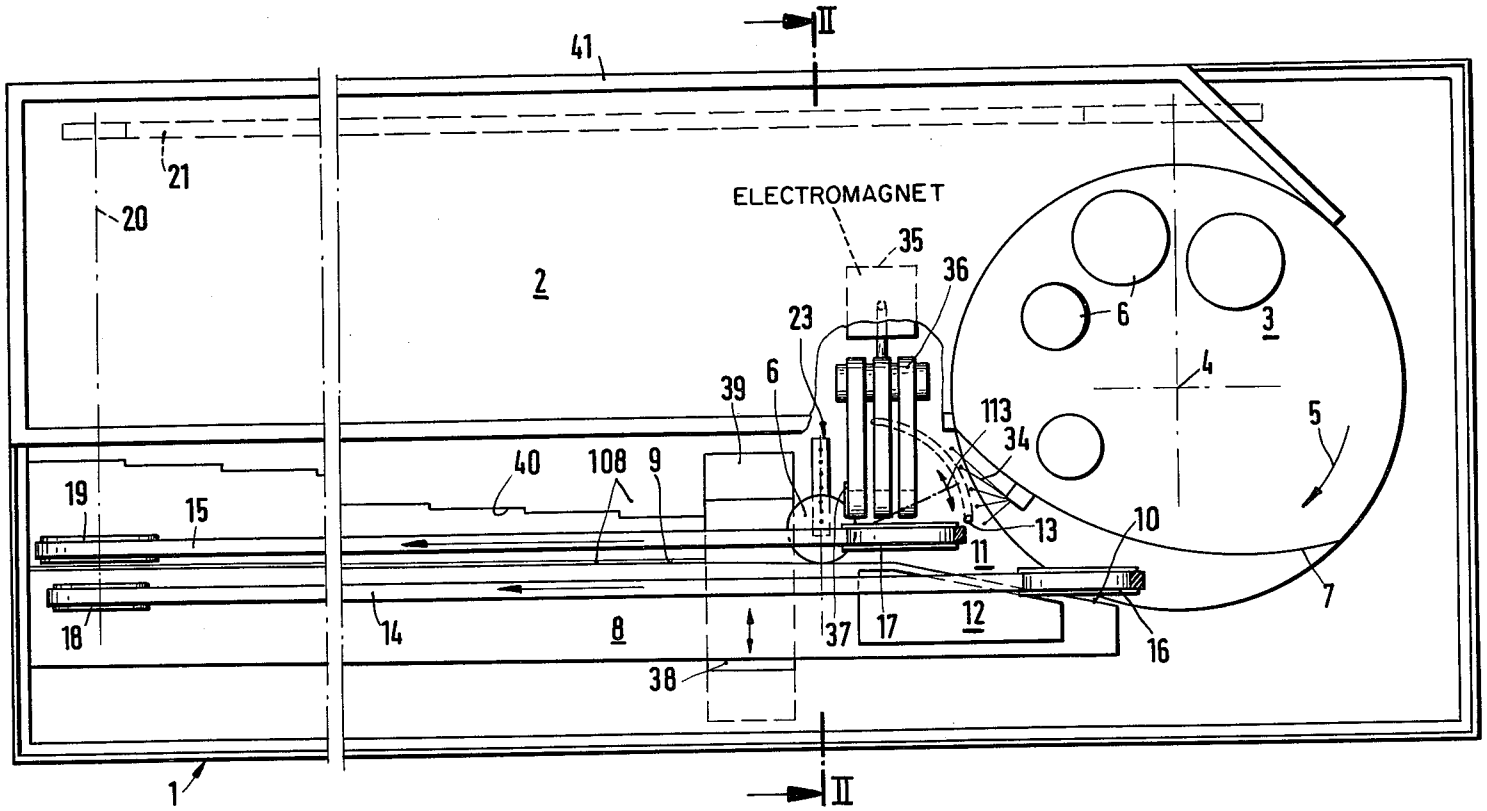
FIG. 1 shows a top view of the coin counting arrangement in accordance with the present invention.

The coin counting arrangement has a housing 1 with a cover plate 2. The latter has a driven rotating centrifugal plate 3 with the axis of rotation 4. The rotation is achieved by an electric motor (not shown) in the direction of arrow 5. The coins 6 differ in diameter and value. A height-adjustable blocking baffle 7 ensures that the coins 6 get only in one position from the centrifugal plate 3 to the exit 11 and are delivered to a guide rail 8 having a guiding edge 9 is rectilinear. Between the guiding edge 9 and the centrifugal plate 3 there is a start-up edge 10 making an oblique angle with guiding edge 9. This start-up edge 10 is tangential to the centrifugal plate and the coins are transported to it tangentially in the direction of rotation of the centrifugal plate 3 (arrow 5). The start-up edge 10 restricts the exit 11 in the direction of the coin movement. The guide rail 8 behind the start-up edge 10 has a drop-out opening 12 through which doubled-up coins are dropped which might be on top of coins 6 contacting start-up edge 10.

Opposite the start-up edge 10 within the guide track 108, there is a spring-loaded rocking lever 13, located in a quarter-circle-shaped groove of guide track 108. The rocking lever 13 provides individual passage to the coins 6 approaching the start-up edge, for further transport. The spring-loaded rocking lever can be pivoted in the direction of arrow 113.

The guide track 108 is essentially horizontal. Above the guide track 108 is an endless pair of belts 14, 15 whose one endless belt 14 approaches the start-up edge 10 behind the centrifugal plate 3 and whose second endless belt 15 runs in front of guiding edge 9. The freely rotating guide roller 16 of the endless belt 14 is mounted above the coin exit 11. The guide roller 17 of the pair of belts 15 is offset against the guide roller 16. The endless belts 14 and 15 are driven via guide roller 18 and 19 which are mounted on a common shaft 20. This shaft is driven via a set of gears by the electric motor (not shown) which also drives the centrifugal plate 3. The guide roller 18 of the endless belt 14 has a smaller diameter than the guide roller 19 of the endless belt 15, so that endless belt 15 has a higher speed than the guide roller 18 of endless belt 14 so that the endless belt 15 runs faster than endless belt 14. The second endless belt 15 and the guiding edge 9 make an angle of about 2° with each other.

Figure 2:
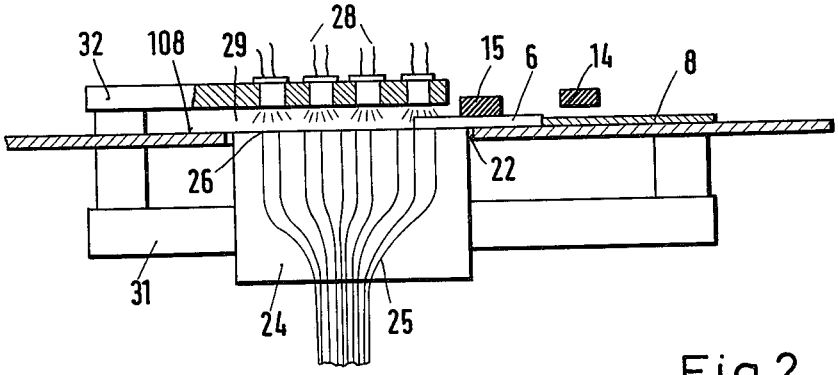
FIG. 2 shows a section taken along II—II in FIG. 1.

The guide track 108 contains a section 22 to accommodate a scanning head 23 with construction as shown in FIG. 2. The scanning head is present only at a single location in the area of the rectilinear part of the guiding edge 9 immediately at the start. It identifies and counts the coins 6 value-wise in conjunction with an electronic counting device associated with it.

The scanning head 23 comprises a photoconductor holder 24 inserted into the guide track 108 in its cutout 22. The free ends 26 of these photoconductors are flush with the surface of the guide track 108 and their other ends are connected to a photocell 27 each. It also comprises a light beam element 28 irradiating the free ends 26 of the photoconductor strands 25. The free ends 26 of the photoconductor strands 25 and the light-beam element 28 are separated from each other by a scanning gap 29 for the coins to pass through.

The photoconductor holder 24 comprises two rectangular metal sheets **24*a* and 24*b* which enclose the photoconductor strands 25 in a straight line. The photoconductor strands can be embedded with liquid iron or plastic in the gap between the two metal sheets 24*a* and 24*b*. The course of the photoconductor strands 25 within the photoconductor holder 24 is shown in FIG. 2. However, the photoconductor strands 25 may also be pasted in drill holes inside the photoconductor holder 24. In either case, the photoconductor strands with their free ends run along a line 30 perpendicualr to guiding edge 9. This line represents the junction of the two halves 24***a* and 24*b* of the photoconductor holder 24, with the free ends essentially flush with the surface of the guide track 108. Each of the coins 6 of a coin series of different diameter may be assigned to a photoconductor strand 25, as shown in the embodiment. However, the photoconductor strands 25 may also be arranged at close regular intervals along the straight line 30 in the photoconductor holder 24, with only one photoconductor strand 25, which is assigned to a coin 6 of the coins of different diameter connected to a photocell 27. The photoconductor holder 24 is located via a carrying rack 31 underneath the guide track 108.

Above the guide track 108 there is another carrying rack 32 which holds the light-beam element 28. It consists of several luminous diodes which illuminate the entire area of the free ends 26 of photoconductor strands 25.

The other ends of the photoconductor strands 25 are connected to the photocells 27 which are located in a photocell holding plate 33. The photocells 27 may be located any place within housing 1 of the arrangement.

The individual photocells 27 are connected to an electronic counter which converts the pulses derived from the photocells 27 into value pulses for the various coins 6.

Figure 3:
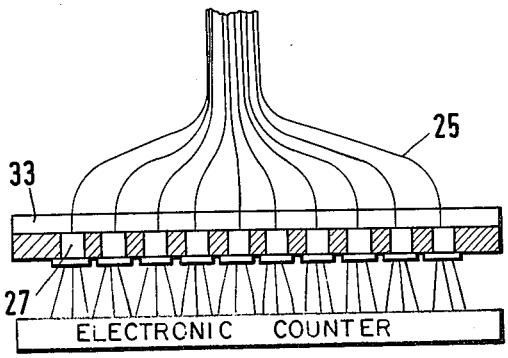
FIG. 3 shows a simplified top view of the scanning head portion, which has been installed (embedded) in the guide track, and the guiding edge for the coins, in a substantially simplified manner.
Figure 3:
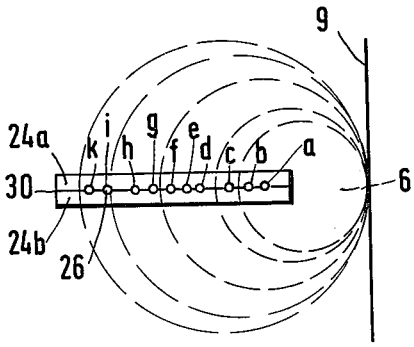

The scanning head operates in the following manner: If no coin 6 is present in the scanning gap 29, all free ends 26 of the photoconductor strands 25 are illuminated by the light-beam element 28. As soon as a coin 6 is moved into the scanning gap 29 by means of the second endless belt 15 along guiding edge 9, one or several photoconductor strands 25 are darkened successively. The number of darkened photoconductor strands indicates the value of the coin 6 on the control device. The value is counted as soon as a photoconductor strand is laid open again by coin 6. As illustrated in FIG. 3, a small coin 6, e.g., a one-penny coin, covers only photoconductor strands *a* and *b* from which the value 1 is determined by the electronic counter. The largest coin, e.g., a 5 DM piece, for example, covers photoconductor strands *a* through *k* whereupon the value 500 is determined by the electronic counter. A medium size coin, e.g., a 1-DM coin, covers the photoconductor strands *a* through *f*. The scanning head 23 has the special advantage that a photoelectric identification of the coins by value can be achieved with minimum space.

Instead of the above-described spring-loaded rocking-lever 13 or in addition to it, one may also provide, to separate the coins 6 leaving the centrifugal plate 3, spring elements 34, directed opposite to the guide track, in the area of the oblique start-up edge 10 and at different distances from it.

The spring elements 34 are fastened to the blocking baffle and are made of bent spring steel wire.

In order to stop the arrangement at a certain quantity of a type of coin, determined by the scanning head, there is located ahead of the scanning head a stopping mechanism comprising three pivotably supported leaf springs controlled by an electromagnet 35, with the free ends of the leaf springs 36 having coatings for holding the coins 6 on the guide track 108. The leaf spring 36 adjacent to scanning head 23 may have an end stop 37 which makes contact directly on the guide track 108 when the electromagnet is energized.

Behind the scanning head 23, in the transport direction of the coins 6, an additional drop-out opening 39, which may be closed by a slide 38, may be embedded in the guide track 108, this makes possible determining the total value of all coins without the coins being transported to a sorting section. In order to sort the coins, whose value has already been determined, by coin type, the guide track 108 is provided with sorting openings of varying widths corresponding to the various diameters of coins 6. Sorting starts with the coin 6 of smallest diameter and ends with coin 6 of largest diameter. This subsequent sorting of coins 6 is functionally completely independent of the identification and counting process which is initiated by scanning head 23.

Part of cover plate 2 of the housing 1 serves as receptacle for the coins. This receptacle is bounded by walls 41 at right angles to cover plate 2. The receptacle extends parallel to the endless belt pair 14, 15 almost throughout the entire length of housing 1 and discharges above the centrifugal plate 3. The coin pile to be counted is poured into the receptacle and is transported from there by pushing or shaking centrifugal plate 3 which delivers the coins tangentially to the first endless belt 14 through which the coins are tangentially transported towards the oblique start-up edge 10 and are pressed against it. Then the coins 6 are passed to endless belt 15 and transported along the guiding edge 9. Because of the higher speed of endless belt 15, the coin sequence is pulled apart. The different speeds and the direction of motion of the empty belt or belts 14 and 15 are indicated by a shorter arrow for the endless belt 14 and a longer arrow for endless belt 15. Coins 6 possibly on top of one another (doubled up) which get into the area of the first endless belt 14, are separated when the lower coin hits start-up edge 10, in that the upper coin is slid over the start-up edge and drops out through drop-out opening 12. Therefore, the start-up edge 10 is slightly lower than the actual guiding edge, facilitating the sliding off of the upper coin of two doubled-up coins at the start-up edge 10.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the this invention, and therefore, such adaptations should and are intended to be comprehended within the meaning and range of equivalence of the following claims.

What is claimed is:

1. An arrangement for the counting of values of different-denomination coins and other disk-shaped objects which are transported in an irregular sequence comprising: a guide track with rectilinear guiding edge on said track, said coins being transported with their rims in an irregular sequence along said rectilinear guiding edge on said track; a scanning head located at the start of the rectilinear guiding edge for identifying a coin and comprising a plurality of photoconductor strands having free ends located at varying distances from said guiding edge; a photocell connected to each of the other ends of said photoconductor strands; a light-beam element illuminating the free ends of said photoconductor strands; said photoconductor strands and said light-beam elements being separated by a scanning gap for passage of the coins; stop means ahead of said scanning head and comprising: at least one pivoted leaf spring, an electromagnet for controlling the positioning of said leaf spring, and a coating on the free end of said leaf spring for holding the coins to said guide track.

2. The arrangement as defined in claim 1 including a photoconductor holder in said guide track, said photoconductor strands being located with their free ends along a line perpendicular to said guiding edge inside said holder, the free ends of said photoconductor strands being flush with the surface of said track.

3. The arrangement as defined in claim 1 wherein said coins are of varying diameter, one photoconductor strand being associated with each of said coins of varying diameter.

4. The arrangement as defined in claim 1 wherein said photoconductor strands are arranged in substantially close regular intervals along a rectilinear line in said photoconductor holder; each photoconductor strand being assigned to one coin of said coins of varying diameter and being connected to a photocell.

5. The arrangement as defined in claim 1 including a centrifugal plate; an oblique start-up edge tangetial to said centrifugal plate; said guiding edge being substantially placed ahead of said scanning head and turning into said oblique start-up edge; said centrifugal plate being rotatable, said coins being tangentially guided toward said start-up edge in the direction of rotation of said centrifugal plate; an endless pair of belts for transporting said coins along said start-up edge and said guiding edge, one of said belts being directed toward said start-up edge behind said centrifugal plate, the other one of said belts passing between said guiding edge and said scanning head, said other belt having a speed substantially greater than said one belt.

6. The arrangement as defined in claim 5 wherein said guiding edge and said other belt form an angle of substantially 0.5°.

7. The arrangement as defined in claim 5 including a spring-loaded rocking lever pivotably located in a quarter-circle-shaped groove in said guide track and facing said start-up edge; said rocking lever forming individual passage to said coins approaching said start-up edge for transport by said other belt.

8. The arrangement as defined in claim 5 including spring elements directed towards said guide track in proximity of said oblique start-up edge and located at different distances therefrom for separating the coins leaving said centrifugal plate.

9. The arrangement as defined in claim 1 including drop-out opening means for said coins and located in said guide track in the transport direction of said coins; and slide closure means for closing said drop-out opening means.

10. An arrangement for the counting of coins of different diameters and similar disk-shaped objects which are transported in an irregular sequence comprising: a guide track with guiding edge on said track, said coins being transported with their rims along said guiding edge on said track; photoconductor strands spaced at different distances from said guiding edge; at least one examining position for said coins; a light-beam element at said examining position; photocells connected to said photoconductor strands; counting means connected to said photocells, said photoconductor strands having free ends inserted in said track at said examining position; first holding means for said photoconductor strands in said track, second holding means for the other ends of said photconductor strands; said photocells are located in said second holding means and connected to said other ends of said photoconductor strands, the free ends of said photoconductor strands being flush with the surface of said track; said photoconductor strands and said light-beam elements being separated by an examining gap for passage of the coins; the free ends of said photoconducting strands being separated from the other ends of said strands for positioning said photocells at a location free of electrical interference, the location of said ends of said photoconductor strands at said examining position allowing examination of a maximum number of different coins over a minimum distance.

11. An arrangement as defined in claim 10 wherein said free ends of said photoconductor strands form said examining position and are located along a rectilinear line perpendicular to said guiding edge.

12. An arrangement as defined in claim 11 wherein said photoconductor strands are arranged in substantially close regular intervals along said rectilinear line in said holding means.

13. An arrangement as defined in claim 12 including a centrifugal plate for separating the coins; and oblique start-up edge in proximity of said centrifugal plate; and spring elements directed towards said guide track in proximity of said oblique start-up edge and located at different distances therefrom for separating the coins leaving said centrifugal pate.

14. An arrangement as defined in claim 10 including stop means ahead of said holding plate for said photocells and comprising: at least one pivoted leaf spring; an electromagnet for controlling the positioning of said leaf spring; and a coating on the free end of said leaf spring for holding the coins to said guide track.

15. An arrangement as defined in claim 10 including drop-out opening means for said coins and located in said guide track in the transport direction of said coins behind said holding plate for said photocells; and slide closure means for closing said drop-out opening means.

* * * * *